United States Patent [19]

Baker

[11] Patent Number: 4,930,770

[45] Date of Patent: Jun. 5, 1990

[54] ECCENTRICALLY LOADED COMPUTERIZED POSITIVE/NEGATIVE EXERCISE MACHINE

[76] Inventor: Norman A. Baker, 323 Oakwood Pl., Menlo Park, Calif. 94025

[21] Appl. No.: 278,671

[22] Filed: Dec. 1, 1988

[51] Int. Cl.[5] ..... A63B 21/24

[52] U.S. Cl. ..... 272/129; 272/128; 272/132; 272/DIG. 6

[58] Field of Search ..... 272/132, 134, 129, 133, 272/131, 72, 128, 135, DIG. 6; 310/93

[56] References Cited

U.S. PATENT DOCUMENTS

| | | | |
|---|---|---|---|
| 3,318,304 | 5/1967 | Gurewich | 128/25 |
| 3,384,493 | 6/1968 | Strittmatter | 73/379 |
| 3,395,698 | 8/1968 | Morehouse | 128/2.05 |
| 3,465,592 | 9/1969 | Perrine | 73/379 |
| 3,767,195 | 10/1973 | Dimick | 272/73 |
| 3,784,194 | 1/1974 | Perrine | 272/79 C |
| 3,848,467 | 11/1974 | Flavell | 73/379 |
| 3,858,873 | 1/1975 | Jones | 272/58 |
| 3,869,121 | 3/1975 | Flavell | 272/79 R |
| 3,896,672 | 7/1975 | Henson et al. | 73/379 |
| 3,902,480 | 9/1975 | Wilson | 128/25 R |
| 3,998,100 | 12/1976 | Pizatella et al. | 73/379 |
| 4,050,310 | 9/1977 | Keiser | 73/379 |
| 4,063,726 | 12/1977 | Wilson | 272/130 |
| 4,176,836 | 12/1979 | Coyle | 272/120 |
| 4,184,678 | 1/1980 | Flavell et al. | 272/129 |
| 4,234,437 | 11/1980 | Ruis et al. | 272/134 |
| 4,261,562 | 4/1981 | Flavell | 272/129 |
| 4,354,676 | 10/1982 | Ariel | 272/129 |
| 4,363,480 | 12/1982 | Fisher et al. | 272/69 |
| 4,479,647 | 10/1984 | Smith | 272/117 |
| 4,483,532 | 11/1984 | Sparks | 272/96 |
| 4,500,089 | 2/1985 | Jones | 272/117 |
| 4,511,137 | 4/1985 | Jones | 272/118 |
| 4,518,163 | 5/1985 | Bruder | 272/132 |
| 4,546,971 | 10/1985 | Raasoch | 272/118 |
| 4,566,692 | 1/1986 | Brentham | 272/130 |
| 4,569,518 | 2/1986 | Fulks | 272/129 |
| 4,609,190 | 9/1986 | Brentham | 272/130 |
| 4,620,703 | 11/1986 | Greenhut | 272/129 |
| 4,678,184 | 7/1987 | Neiger et al. | 272/129 |
| 4,714,244 | 12/1987 | Kolomayets et al. | 272/72 |

OTHER PUBLICATIONS

Darden, Ellington, Ph.D., *The Nautilus Bodybuilding Book,* 1982, Chapters 13 & 14.

Jorgensen, K., *Force-Velocity Relationships in Human Flexors and Extensors,* Biomechanics, University Park Press, 1976, pp. 145-151.

Goldspink, G., *Energy Turnover During Contraction of*

(List continued on next page.)

*Primary Examiner*—Richard J. Apley
*Assistant Examiner*—Joe H. Cheng
*Attorney, Agent, or Firm*—Blakely, Sokoloff, Taylor & Zafman

[57] ABSTRACT

A processor controlled eccentrically loaded exercise machine for providing a resisting or powering force which can be varied by position in order to carry out positive or negative exercise strokes. A variable torque motor provides a torque to a torque coupler. The torque coupler is coupled to the user interface device through a mechanical link. During a positive exercise stroke, the motor supplies a torque to a slipping torque coupler so as to provide an eccentrically loaded resisting force, which resists the force exerted by the user in moving the exercising device as his muscle contracts. During a negative exercise stroke, the torque coupler engages to provide a powering force, as supplied by torque motor, against the contracted muscle of the user. A position sensor and a load cell are coupled to the user interface device for providing position and force signals to the processor. The processor, by controlling the motor torque and the torque coupling of the torque coupler, is capable of providing a resisting or powering force which can be varied by position for providing various modes of exercise available to the user, including the ability to immediately switch between positive-negative or negative-positive exercise at any position within the exercise machines range of motion.

21 Claims, 2 Drawing Sheets

OTHER PUBLICATIONS

*Different Types of Muscle,* Biomechanics, University Park Press, 1978, pp. 27–39.

Buchtal F., & H. Schamalbruch, *Contraction Times and Fibers Types in Intact Human Muscle,* ACTA Physiol. Scand., 79:435–439, 1970.

G. A. Cavagna, F. P. Saibene, and R. Margaria, *Effect of Negative Work on the Amount of Positive Work Performed by an Isolated Muscle,* J. Appl. Physiol., 20:157–158, 1965.

Huxley, A. F., *Mechanical Properties of the Cross—Bridges of Frog Striated Muscle,* J. Physiol., 218:58–60, 1971.

Iles, J. F., *Responses in Human Pretibial Muscles to Sudden Stretch and to Nerve Stimulation,* Exp. Brain Res., 30:451–470, 1977.

I. Jacobs, P. Tesch, *Short Time, Maximal Muscular Performance: Relation to Muscle Lactate and Fiber Type in Females,* Medicine Sport, vol. 14, Basel: Karger, 1981, pp. 125–132.

P. V. Komi, H. Suominen, E. Heikkinen, J. Karlsson and P. Tesch, *Effects of Heavy Resistance and Explosive-Type Strength Training Methods on Mechanical, Functional, and Metabolic Aspects of Performance,* Exercise & Sport Biology, Human Kinetics, 1982, pp. 90–102.

Komi, P. V., *Measurement of the Force-Velocity Relationship in Human Muscle under Concentric and Eccentric Contractions,* Biomechanics III Basel: Karger, 1973, pp. 224–229.

B. C. Abbott, B. Bigland, J. M. Ritchie, *The Physiological Cost of Negative Work,* J. Physiology, 117:380–390; 1952.

E. Asmusson, *Positive & Negative Muscular Work,* ACTA Physicol. Scand., 28:364–382, 1952.

K. Hakkinen, P. V. Komi, P. A. Tesch, *Effect of Combined Concentric and Eccentric Strength Training and Detraining on Force-Time, Muscle Fiber and Metabolic Characteristics of Leg Extensor Muscles,* Scand. J. Sports Sci., 3:50–58, 1981.

M. Kaneko, P. V. Komi, O. Aura, Mechanical Efficiency of Concentric and Eccentric Exercises Performed with Medium to Fast Contraction Rates, Scand. J. Sports Sci., pp. 15–20, 1984.

ECCENTRICALLY LOADED COMPUTERIZED POSITIVE/NEGATIVE EXERCISE MACHINE

BACKGROUND OF THE INVENTION

1. Field of the Invention

The present invention relates to the field of exercise devices, and more particularly to automated exercise machines capable of providing positive and negative exercises.

2. Prior Art

In the field of muscular development, a variety of theories exist for achieving maximum muscular development. A great number of exercise devices are available, each focussing its functionality to one or more of these theories. For example, isokinetic devices regulate or control the rate of muscular contraction regardless of the force applied to the device by a user's muscular contraction. For example, in an isokinetic device where a weight is attached to a bar and where the user initiates actions with the bar, the isokinetic device only regulates the speed of the movement of the bar. U.S. Pat. No. 4,483,532 teaches the use of a centrifugal brake to increase movement resistance as the velocity of the exercise bar is increased above some preset value. U.S. Pat. No. 4,363,480 teaches the use of a centrifugally regulated frictional resistance device to control the speed of a treadmill regardless of the amount of force exerted by the user.

Another class of devices provide for positive only non-eccentrically loaded use. These devices provide for the regulation of the resistance force against the user, only when the bar is moving, but do not control the bar speed during the exercise, such as when a muscle contracts during a positive exercise. For example, U.S. Pat. No. 4,354,676 teaches the use of a computer controlled valve to regulate the internal pressure of a hydraulic cylinder connected to the exercise bar. U.S. Pat. No. 4,609,190 teaches the use of a double acting hydraulic cylinder with an assorted control valve for each cylinder to resist the exercise bar movement by providing a different resisting force for resisting movement. However, most of these hydraulic devices provide for positive exercise only.

Whereas many of these positive only exercise devices utilize a hydraulic cylinder to vary the resistance force, some machines use an electrically controlled friction brake which is typically coupled between the exercise bar and the user. The resisting force is varied by the amount of friction applied to a rotating member on the exercise bar. U.S. Pat. No. 4,261,562 teaches the use of a DC generator as a variable force resistance device in which the electrical loading coupled to the generator is varied. U.S. Pat. No. 4,063,726 also utilizes a hydraulic cylinder and having an electronically controlled valve to vary the resistance force.

A third category of exercise devices deals with positive and negative stroke operating devices. This category contains a wide variety of mechanical, electronic, and electro-mechanical devices to provide exercise in both positive and negative directions. For example, U.S. Pat. No. 3,858,873 provides for a use of a spiral cam coupled between the exercise bar and a stack of metal weights to provide an increasing force during a positive exercise stroke. U.S. Pat. No. 3,848,467 uses a speed controlled motor in the negative stroke and a friction brake in the positive stroke of an exercise. U.S. Pat. No. 4,569,518 utilizes a variable torque transmitting clutch for both positive and negative stroke control. U.S. Pat. No. 4,235,437 teaches the use of a hydraulic pump and electrically controlled valves to vary the force or the speed of positive and negative strokes.

Although various exercise devices are described above in relation to a number of example exercise categories, most of these devices stress a particular type of exercise for achieving maximum muscle development. It is generally known that maximum isolation of a given muscle by a particular exercise device produces the greatest amount of strength increase during exercise. Secondly, because the strength of the muscle varies, depending on its degree of contraction, and because the amount of force that the muscle can apply varies by the bone-joint angle, the resisting force must vary as a function of the contraction of the muscle to attain maximal strength gained during the exercise.

The various exercise devices described above, although based on various exercise theories, provide for muscular development by providing a resistive force to a contracting muscle. Muscle contraction can be generally classified as being concentric, isometric, or eccentric. Concentric contraction refers to a situation of the muscle when it shortens its length. A simple example of concentric contraction is when a weight is lifted from a rest position. Because the weight is accelerated from its initial position, positive work is achieved as the contracting muscle expends energy in lifting the weight. This is referred to as positive exercise.

Isometric contraction occurs when two forces are at equilibrium so that movement cannot occur. Although work is not performed, the muscle under contraction still expends energy in counteracting the other force. Isometric contraction provides for a holding exercise, which is neither positive or negative. A third type of contraction is eccentric contraction. A simple example is the lowering of a weight to its rest position. In eccentric contraction, the weight is decelerated and the total work performed is negative because the muscle absorbs energy in decelerating the weight. Therefore negative exercise is performed by eccentric contraction. In eccentric contraction, muscle is lengthened from its contracted or previously contracted position. That is, the muscle is being lengthened by a load or a force greater than the muscle's holding force.

In a concentric contraction exercise, positive strength is used in which the muscle is shortened against a force or resistance, such as in lifting a weight. In a concentric exercise system, also called a positive exercise system, an object is moved by the muscular contraction, such as by lifting, so that it will cause the muscle to expend energy and this energy is stored in the object. In this instance, the lifting force of the muscle must exceed the resistive force of the object. When the force expended by the muscle equals the weight of the object, this holding strength of the muscle provides the isometric contraction. In an isometric contraction, no movement occurs but energy is expended by the muscle.

An eccentric exercise involving negative strength will occur when the force exerted by the muscle is less than the resistive force of the object, which was previously lifted. As the object is lowered, the potential energy stored in the object is converted to kinetic energy and absorbed by the muscle. The muscle lengthens from the previously contracted position. An eccentric exercise system is based on a force overcoming a contracted muscle. That is, the force (weight) is greater than the muscle's holding force.

It is generally known that not only is the direction of exercise important, but emphasis is placed on the type of resistive force (or load) opposing the muscle to be exercised. An eccentric load provides a stretching or pulling force against the contracting muscle and can occur during positive or negative exercise stroke. An eccentrically loaded exercise system is one in which an object moved by the muscular contraction stores this energy, not merely dissipating it, that is the exercise system possesses potential energy which is available to do work on the contracted muscle whenever the muscle force becomes less than the force supplied by the exercise machine.

In actual life, the combination of eccentric and concentric contractions operate together, such as when lifting and lowering a weight. Further, the combination of eccentric and concentric contractions form a natural type of muscle function called a "stretch-shortening cycle". The stretch-shortening cycle allows the concentric contraction to take place with greater force or power output, as compared to initiating a movement by concentric contraction alone. This phenomenon is believed to occur partly due to the elastic nature of the muscle during and immediately after the eccentric contraction. The lengthening of the contracted muscle modifies the condition of the muscle such that the stretched muscle increases its tension and stores potential energy. Part of this stored energy can be recovered provided that the concentric contraction occurs rapidly after the eccentric contraction.

Further, in comparing negative exercise to positive exercise, negative only exercise produces at least as much, if not greater, muscle growth than positive only exercise. Strength increase of as much as 40% has been documented by the use of negative exercise (Ettington Darden; *The Nautilus Bodybuilding Book*; Chapters 13–14; Contemporary Books, Inc,; 1982). Furthermore, the negative exercise provides other advantages, such as stretching for the improvement of flexibility; prestretching for high-intensity muscular contraction; resistance in the position of full contraction for full range exercise; and maximum application of resistance throughout a full range of possible movement.

Additionally, not only is the direction of the exercise a critical factor, but the speed of the velocity of the exercise in both directions is also extremely important. This factor will determine the rate of muscular contraction and lengthening during the exercise phase. Further, peak mechanical efficiencies of different types of muscle fibers occur at different velocities of shortening. For example, the maximum efficiency of fast twitch fibers appears to appear at high contractive speeds, whereas slow twitch fibers show corresponding peak efficiency at lower contraction speeds (Goldspink G; *Energy Turnover During Contraction of Different Types of Muscle*; Biomechanics; pp 27–39; University Park Press; 1978). Therefore, the individual's ideal rate of contraction and lengthening can be determined by strength testing of the muscle at various speeds.

It is appreciated than that what is needed is an exercise device that provides for both positive and negative exercises with eccentric loading, provides variable positive and negative forces, controls the speed of the device in both directions, and also provides for the testing of the muscle for positive and negative strength at various speeds.

SUMMARY OF THE INVENTION

The present invention describes a computer controlled exercise machine for providing a variety of exercise regimen. The exercise machine of the present invention provides a positionally variable resisting force against a contracting muscle while regulating the speed of the muscle's contraction to its ideal rate during positive exercise, and applies a positionally variable stretching force to the contracted muscle while controlling the muscle's lengthening speed to its ideal rate during a negative exercise.

A user interface device (UID) is rotatably mounted on a rigid frame for the engagement of a specific body part of the user. The UID is coupled to a variable powering and resisting means comprised of a motor and a torque coupler, respectively. The motor and the torque coupler provides movement of the UID in one direction when the user's contracting muscular force is greater than the resisting force provided and the UID moves in the opposite direction when the powering force from the motor and the torque coupler is greater than the muscle's holding force. The motor and the torque coupler are coupled and controlled by a processor. A position sensor and a force sensor are coupled to the UID for providing UID position and force information to the processor, respectively.

The driving force to the UID is provided by a DC permanent magnet motor which supplies a variable amount of torque to the input housing member of a magnetic particle torque coupler. The motor torque supplied to the torque coupler is coupled to a current control board which is controlled by signals from the processor. Current flow to the motor is controlled by the torque control board thereby regulating the torque of the motor. The torque coupler is comprised of a housing and an output rotor which is free to rotate in a space between the two members of the coupler housing. The gap between the rotor and the housing is filled with a fine magnetic powder which is loose, until a magnetic field is applied to it by a coil surrounding the circumference of the housing. When the magnetic field is applied, the powder particles form chains along the magnetic field lines bonding the rotor to the housing with a friction of force directly proportionally to the current supply to the coil. The coupling force can be readily varied by controlling the current provided to the coil.

A torque coupler control board which receives control signals from the processor provides the necessary current to the coil of the torque coupler, thereby controlling the amount of torque coupled from the motor to an output shaft of the torque coupler. There is no slip between the rotor and the housing unit until the input torque exceeds the coupling torque or the output load is greater than the coupling force. Therefore, the motor can transmit a preselected amount of torque through the torque coupler allowing the motor to provide a full amount of force to the UID, but prevents the user from stalling the motor when the user force is increased above the amount provided by the motor torque.

The output rotor of the torque coupler is coupled to a helical gear reducer/increaser which output shaft is then coupled by sprocket and chain assembly to the UID. The amount of force applied to the user over the movement path of the UID can be varied in an infinite manner. The applied force is regulated by the motor current and further regulated by the torque coupler. The rapid synchronous control of both the motor and the torque coupler allows for various preselected force V. position curve to precise values without the danger of the motor stalling by an excess application of user force on the UID. Further, user interface is provided by a keyboard and a graphics display monitor. A memory is coupled to the processor for providing storage of a feed forward control program for running the exercise routine, a control parameter table for storing various apparatus parameters and for storing user inputed data.

DETAILED DESCRIPTION OF THE PRESENT INVENTION

A computerized positive/negative exercise machine is disclosed in which an exercise regimen can be programmed for a specific user. In the following description, numerous specific details are set forth such as specific mechanical and electrical components, etc., in order to provide a thorough understanding of the present invention. However, it will be obvious to one skilled in the art that the present invention may be practiced without these specific details. In other instances, well-known structures have not been described in detail in order not to unnecessarily obscure the present invention.

The present invention provides for a skeletal muscle exercise machine, wherein an isolated muscle contracts against a rotatably mounted user interface device (UID). The UID is coupled to a variable powering and resisting means which is capable of providing a force at a given position of the UID while controlling the exercise speed to the ideal rate for the particular muscle being exercised. The present invention provides for dual mode by controlling the speed and the force applied to the UID. The system is automated by the use of a computer which processes a complex feed forward control program, therein allowing the exercise system to operate at high speeds without overshoot or undershoot of the selected forces.

Figure 1:
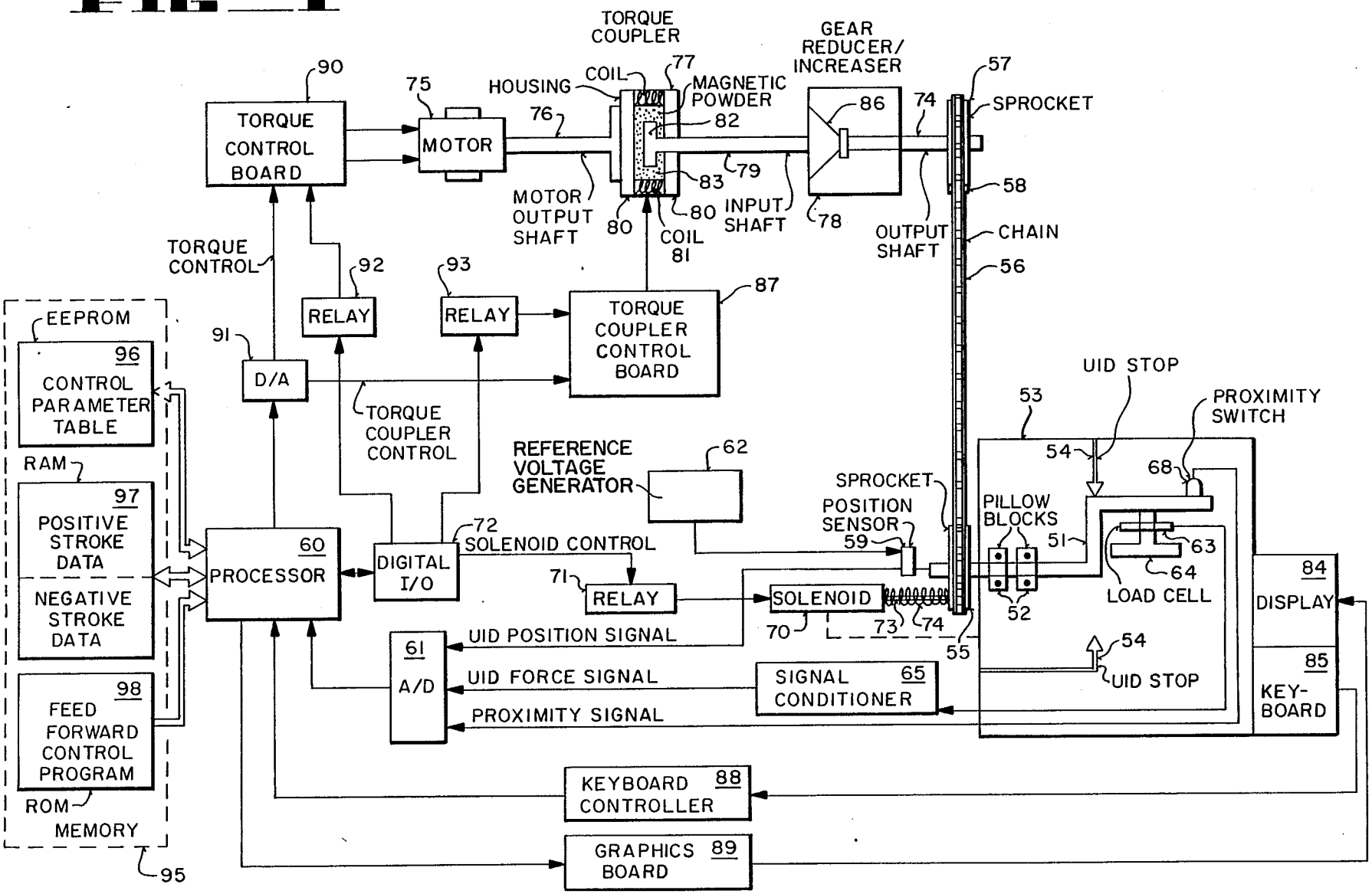
FIG. 1 is a schematic block diagram of a positive/-negative exercise machine of the preferred embodiment.

Referring the FIG. 1, a UID 51 is rotatably mounted on a rigid frame 53. It is to be noted that UID 51 need not be rotatably mounted and that other motions, such as up-down motion, can be used. Frame 53 functions as a rigid structure to house UID 51. UID 51 can be of a variety of exercise devices, including prior art devices. For simplicity, the example used here to describe UID 51 is an exercise bar which rotates whenever a user operates the bar. However, it is to be noted that a variety of devices can be used for UID 51, wherein the given device will be designed for the engagement of a specific body part(s) which is to be exercised. UID 51 is rotatably mounted on pillow blocks 52 to the rigid frame 53. Frame 53 includes mechanical UID stops 54, located at the ends of UID travel, to terminate UID motion when UID 51 reaches stops 54. Mechanical stops 54 provide for a predetermined range of motion for UID 51. UID 51 is coupled to a sprocket 55. Sprocket 55 is coupled to sprocket 57 by a linking means, which in this instance is a chain 56. The sprocket and chain assembly also includes a chain tensioner 58 to maintain proper tension on chain 56. Although a chain and sprocket system is shown, other devices can be readily used to provide the linking means.

A position sensor 59 is mounted to UID 51 for providing a UID position signal to a central processor through an analog-to-digital (A/D) converter 61. Position sensor 59 provides an analog signal corresponding to the position of the UID 51. The preferred embodiment uses a potentiometer to provide the position sensor 59, however, other devices can be readily used. The analog UID position signal is coupled to A/D converter 61 for conversion to digital format prior to being coupled as an input to processor 60. A reference voltage generator 62 provides a reference voltage to position sensor 59 so that a precision reference is available for the UID position signal.

A load cell 63 is mounted between UID 51 and the user for the purpose of sensing the load on the UID 51. The load cell 63 senses the force applied by the user on bar 64 and sends a UID force signal to processor 60. The force signal from load cell 63 is coupled to the A/D converter 61 through a signal conditioner 65 and then to the processor 60. In the preferred embodiment load cell 63 is a strain gauge. A proximity switch 68 is mounted onto UID 51 in such a way that it is in position to contact a part of the users body which is in motion, such as the user's hand. In the preferred embodiment, proximity switch 68 is a capacitive switch which is activated when the user's hand contacts the bar 64. The proximity switch 68 sends a proximity signal through A/D converter 61 when the user makes physical contact during the exercise.

Also mounted to frame 53 is a solenoid 70 and control relay 71. A solenoid control signal is provided from a digital input/output (I/O) board 72 is coupled to control relay 71. Control relay 71 is controlled by the solenoid control signal and is coupled to energize solenoid 70. Solenoid 70 includes a solenoid shaft 73 within solenoid spring 74, wherein shaft 73 is normally extended by spring 74 so that shaft 73 extends into sprocket 55 to lock sprocket 55 when the solenoid 70 is not energized. The digital I/O board 72 provides the solenoid control signal to relay 71 which then activates solenoid 70 to retract shaft 73 and permit sprocket 55 to rotate. During accidental power loss, the solenoid is deactivated causing the UID 51 to be placed in a locked position.

A variable torque and variable rpm motor 75 is mounted to or approximate to frame 53. The motor 75 has an output shaft 76 which is coupled to a torque coupler 77. Torque coupler 77 controls the amount of torque coupled from motor 75 to gear reducer/increaser 78. Gear reducer/increaser 78 includes an input shaft 79, which is coupled to receive the torque from torque coupler 77, and an output shaft 74 which is coupled to sprocket 57.

The torque coupler 77 of the preferred embodiment is a variable viscosity electromagnetic torque coupler. Torque coupler 77 is comprised of housing 80, coil 81, an output rotor 82 and magnetic powder 83 surrounding the output rotor 82. The housing 80 is actually comprised of two members as shown in FIG. 1. Output rotor 82 is then coupled to input shaft 79 of gear reducer/increaser 78. Further, torque coupler 77 is coupled to receive a control signal from a torque coupler control board 87.

In operation, motor torque is delivered to housing 80, wherein the rotation of housing 80 causes the magnetic powder 83 to be centrifugally forced away from output rotor 82, which is slotted. Torque coupler control board 87 supplies variable current to coil 81, so that as the current is increased, the magnetic powder is caused to move toward the output rotor 82 and fills the slots of the output rotor 82. As current from torque coupler control board 87 increases further, more powder 83 fills output rotor 82. In essence, the magnetic powder 83 becomes more viscous and causes the transfer of additional rotary torque from housing 80 to output rotor 82. By controlling the current from torque coupler control board 87, the amount of torque coupled from motor 75 to gear reducer/increaser 78 can be controlled.

The torque coupler 77 includes the input member of housing 80 which is coupled to the variable torque motor 75. The slotted output rotor 82 is free to rotate in a pocket between the two housing members. The rotor 82 does not contact the housing 80, but the gap between the rotor 82 and the housing 80 is filled with a fine stainless steel magnetic powder 83. The powder is a free flowing non-friction material until an electro-magnetic field is applied to it from the coil 81 formed about the circumference of the housing 80. The powder particles form chains along magnetic field lines and are bound together by magnetic attraction caused by the magnetic field caused by the coil 81. These chains form across the slots located in the rotor 82 and couple the rotor 82 to the housing. The torque coupling limit is proportional to the magnetic field and therefore is proportional to the DC current applied to the coil 81. Because the rotor's slots tend to cut across these magnetic chains, the strength of the chains can be termed as "viscosity" (or the resistance to pulling apart).

The gear reducer/increaser 78 of the preferred embodiment uses a helical gear to reduce the rpm from the input shaft 79 to the output shaft 74. In effect, by reducing the rpm the input torque is multiplied wherein the multiplied output torque is supplied to sprocket 57.

Motor 75 is coupled to a torque control board 90. Torque control board 90 provides the necessary voltage and current for operating motor 75. The motor 75 of the preferred embodiment is a DC permanent magnet motor. Because the torque of a DC motor is proportional to the supplied current, torque control board 90 controls the torque provided by motor 75 by controlling the current supplied to the motor 75. Processor 60 is coupled to torque control board 90 through a D/A converter 91 to provide a torque control signal to the board 90, which then controls the motor 75. Further, processor 60 is also coupled to the torque coupler control board 87 through a D/A converter 91 to provide a torque coupler control signal to the board 87, which controls the viscosity of the magnetic power 83. Therefore, the output torque can be controlled by either controlling the torque provided by the motor 75 or the torque coupled through torque coupler 77.

Processor 60 is coupled to digital I/O board 72 which is then coupled, not only to the solenoid control relay 71, but also to relays 92 and 93. Relay 92, when activated, activates torque control board 90 and relay 93 activates torque coupler control board 87. Processor 60 is also coupled to a memory 95. In the preferred embodiment memory 95 is comprised of three separate memory units 96, 97 and 98. Memory 96 stores a control parameter table, memory 97 stores positive and negative exercise stroke data and memory 98 stores a feed forward control program. Because the feed forward control program is fixed, a read-only memory (ROM) is used for memory 98. In the preferred embodiment, memory 96 is comprised of an electrically erasable programmable read-only memory (EEPROM) and memory 97 is comprised of a random-access memory (RAM). It is to be appreciated that although a given memory devices are described in reference to memories 96–98, that other memory devices can be readily substituted. Further, the processor 60 of the preferred embodiment is a single board personal computer, however, various other processors and computers can be readily adapted for processor 60.

Processor 60 is also coupled to a graphics board 89 which is then coupled to a video display unit 84, disposed at or in the vicinity of frame 53. A key board 85 is also proximate to the user so that the user can input various processor commands. Keyboard 85 is coupled to a keyboard controller board 88 which is then coupled to the processor 60. Instructions to the processor 60 are provided as an input at keyboard 85 by the user and information to be provided to the user is displayed on the display 84. Display 84 of the preferred embodiment is a color viewing monitor. It is to be appreciated that the preferred embodiment illustrates one structure of the present invention and that other embodiments can be readily implemented without departing from the spirit and scope of the present invention.

During a positive exercise routine, a primary function of the torque coupler 77 is to generate and vary an eccentrically loaded resistance force which opposes a user's applied muscular contraction force, such as when the user is forcing the movement of the UID. At the beginning of the positive stroke, the motor torque is adjusted to provide a greater resisting force than is desired by the user. The motor torque is controlled by controlling the current supply to the motor 75 from torque control board 90. The requisite motor current control information is stored in the non-volatile EEPROM memory 96 and processed by the processor 60, which provides the torque control signal to torque control board 90. Once the current control value is set, the processor 60 adjusts the torque control to provide approximately 99% (less than 100%) of the desired user force. Because the processor 60 causes the motor to produce more torque than that which is to be coupled from the torque coupler 77, the torque coupler housing 80 is caused to rotate around the stalled output rotor 82. The torque coupler control board 87 allows the coupler 77 to slip. The magnetic powder 83 applies a pulling force on the stalled torque control rotor 82 and this pull is applied to the user as an eccentric load or as a stretching force. This force is also referred to as a "muscle pre-stretch".

As the pre-stretched muscle begins to contract when the user exerts a force against the UID 51 causing it to rotate, the user applies a force to the UID 51. When the force of the muscle approach the desired value of 100%, the muscle force exceeds the UID resisting force provided by the torque coupler 77 and the user will cause the UID 51 to rotate. The movement of the UID 51 is coupled to torque coupler 77 through chain 56 and gear reducer/increaser 78. The gear reducer/increaser 78 causes the rotor 82 to rotate in the opposite direction than that of the motor output shaft 76 and housing 80. That is, the motor 75 and torque coupler 77 attempts to turn rotor 82 in the opposite direction than the direction of movement of rotor 82 caused by the movement of UID 51. At this point, the opposing resistance can remain constant, or alternatively, can be varied by varying the motor torque and the force coupled by torque coupler 77. It is to be understood that both the motor torque and the force coupled through by torque coupler 77 must be increased, because just increasing the torque coupler 77 will more than likely cause the motor 75 to stall. However, if a rapid force reduction is necessary, such as for safety reasons, a signal from the processor to the torque coupler control board 87 will cause the torque coupler 77 to decouple the desired force value quickly. During the performance of the positive stroke of the exercise, the motor torque from motor 75 and the coupling force through torque coupler 77 is controlled by appropriate control signals from the processor 60.

When a negative exercise stroke is to be performed, the motor torque is set to a slightly greater value than that desired by the user. That is, the torque coupler couples a force that is approximately 101% (more than 100%) of the desired force. At the beginning of the negative stroke, the user is instructed to lower the user's resisting force to that of the desired value so that the force coupled to UID 51 causes the movement of the UID 51. Because the users exerted force is slightly less than that of the force coupled to UID 51 by torque coupler 77, the movement of UID 51 performs a negative exercise stroke. In the negative exercise stroke, the force being applied to the user is controlled by the motor torque. The torque coupler 77 is utilized as a torque limiter in this instance, such that if the user's force increases above the desired value, the increase load is not coupled back to the motor thus preventing the motor from stalling.

During the operation of the system shown in FIG. 1, UID position is sensed by position sensor 59 and transmitted to processor 60 by way of A/D converter 61. A precision voltage reference source 62 provides the reference voltage which is used by position sensor 59. The UID position signal from position sensor 59 provides an analog value which corresponds to the position of the sensor 59. A load cell 63 provides a UID force signal to processor 60 by way of A/D converter 61, wherein this signal from the load cell is conditioned by signal conditioner 65 before being coupled to converter 61. The UID force signal provides an analog value corresponding to the amount of force exerted on cell 63. Proximity switch 68 provides a proximity signal to processor 60 by way of A/D converter 61 also, wherein this signal is used to determine if the user is in the proper position to begin the exercise.

The user is capable of inputting information through keyboard 85, which is coupled to processors 60 through keyboard controller 88. Information is provided to the user by way of display unit 84 which provides a graphics display, controlled by graphics board 89. It is to be appreciated that UID position signal when operated on by the processor allows the processor to determine the speed of the movement of the UID 51. The feedback signals coupled through A/D converter 61 provides feedback information to processor 60. The actual value is compared to the desired value in processor 60 and the difference between the two is calculated as the error value. The processor 60 uses the error value to correct signals sent to torque control board 90 and torque coupler control board 87. The error correction will compensate either or both the motor torque 75 and the force coupled through torque coupler 77, until the actual values reflect the desired values.

ROM 98 stores a feed forward control program which runs processor 60. The feed forward control program is a program which is capable of assessing the feed back inputs from UID 51 to processor 60 and determining a future response to such feedback inputs. EEPROM 96 includes a control parameter table which can be readily reprogrammed. The control parameter table is comprised of parameters pertaining to the equipment, analog signal levels and user application values wherein these operating characteristics of the machine are initially inputted at the time of the machine's initial installation. Further, these parameters can be readily recalibrated as operating characteristics of the machine change from repeated use and age.

The information which changes during each use is stored in RAM 97. Such information includes data provided by the user through keyboard 85 for programming the particular user's specific exercise regimen, as well as retaining positive and negative exercise stroke data for immediate or future display. Further, it is to be appreciated that calibration routines can be readily stored in ROM 98 and/or EEPROM 96 for calibrating the machine.

An exercise session is typically commenced by the user being positioned at the UID 51. The user then interacts with the system by inputing commands through the keyboard 85. Instructions, as well as prompts, can be provided by the display unit 84. In one technique, the user can input the desired force values at various points traveled by the UID 51. Force values at various points of the positive and negative strokes can be manually entered through the keyboard. In a second technique, the user need only specify the maximum positive force and the maximum negative force. The processor 60 will generate the other force values according to a given force curve which can be selected by the user or it could also be a default curve selected by the processor 60. Regardless of the number of specified inputs, the processor will provide the other values for a continuous force curve. Almost an infinite (continuous) number of positions is calculated to provide a smooth transition of UID 51 throughout its exercise path.

During the exercise session, the UID 51 will resist a contraction of the isolated muscle during the positive exercise stroke and will lengthen the muscle against its force of contraction in the opposite direction during the negative exercise stroke. As the user applies a force to the UID that is greater than its resisting force, the UID will rotate because the force coupled to UID 51 from torque coupler 77 is less than the force exerted by the user. During the positive exercise stroke, the gear reducer/increaser operates as a speed increaser to rotate the input shaft 79 and the rotor 82 due to the rotation of UID 51. The motor 75 is rotating in the opposite direction as the back driven rotor 82 and therefore spins the attached torque coupler housing 80 and the viscous magnetic powder 83 against the counter rotating rotor 82. The resisting force opposing the user's contracting muscle is controlled by the torque supplied from the motor 75 and the viscosity of the powder determined by the strength of the field generated by the coil 81. The viscosity of the torque coupler 77 is set to slip at approximately 99% of the user's force. Because the resistance to the user's force is provided by torque coupler 77, the counter rotation of rotor 82 against the magnetic powder 83 and housing 80 causes the user's muscular energy to be converted to heat by the friction between the rotor 82 and powder 83. Therefore, torque coupler 77 absorbs the kinetic energy during a positive exercise stroke.

When the users applied force equals the force coupled by the torque coupler 77, the two forces oppose each other equally and UID 51 movement stops. As long as the two forces are in equilibrium, the user is capable of performing an isometric exercise. At this point, the user can continue to perform the positive exercise stroke if the UID 51 has not reached its upper stop 54. When the UID 51 has moved completely through its positive stroke portion of the exercise, which can be at any point along the travel of UID 51, or when it has reached its upper stop 54, the UID 51 will come to rest and an equilibrium condition is reached. At this equilibrium point rotor 82 is stalled, however, motor 75 and its output shaft 76, as well as housing 80, will continue to rotate placing an eccentric load onto the muscle being exercised.

Then, the negative exercise stroke is commenced by the processor 60 causing an increase in the motor torque, as well as an increase in the amount of force coupled by torque coupler 77. The coupling force is increased to approximately 101%, which is slightly above the users applied force. As the UID 51 force increases above the force exerted by the user, UID 51 will move in the opposite direction than that of the positive stroke, thereby providing the negative exercise stroke. The force exerted by motor 75 and torque coupler 77 can be maintained at a steady value or, in the alternative, the force can be varied to maintain a steady speed of the UID 51. If a steady speed of UID 51 is desired, and the UID speed varies from the desired value, the user is instructed to correct the user applied force via the display unit 84. In the event variable force and/or variable speed is to be provided to the user, the processor 60 can accommodate such variations readily. If UID 51 stops due to the increase in the user force, the torque coupler 77 continues to apply an eccentric load to the muscle. Therefore, the torque coupler 77 functions as a torque coupler only until the preset user force is reached, then it operates as a torque limiter and as an eccentric loading device.

Because of the processor control of the positive and negative exercise strokes, various exercise regimens can be initiated by the user. As stated previously the user can specify the maximum positive force and the maximum negative force and the processor will calculate an average strength curve for these values and create a force versus position table for the entire exercise. Alternatively, the user can input various force values throughout the movement of the UID 51 and the processor 60 can generate an average strength curve based on these limited inputs. That is, regardless of the number of positions selected by the user, the processor 60 divides the exercise stroke into an almost infinite number of positions to calculate the force needed at these positions. This allows for an absolutely smooth transition of force values as UID 51 travels through its exercise path.

In another technique, the user specifies the length of time for the two exercise strokes and the processor 60 will maintain the UID 51 speed regardless of user force. This is synonymous to providing an isokinetic exercise.

In another alternative method, the processor 60 can measure the user's strength at various positions for either or both positive and negative strokes during an initial exercise cycle and then create an exercise curve based on these initial values.

In another technique, the present invention is capable of providing a "feel" of a free weight device such as a barbell. The user senses the resistance provided by the UID 51 as though it is a resistance caused by the acceleration of gravity (free weight). The processor operates to exert a resisting force against the user wherein this resistance simulates a force of gravity. That is, in a free weight system, the conservation of energy dictates that whenever the user's force decreases below the force of the UID (weight) of the device, the device must immediately accelerate.

For example, during a negative exercise stroke, the system is capable of providing automatic acceleration to simulate the force of gravity. The UID 51 speed is monitored by the processor 60 and the user is instructed to maintain this speed. The torque control board 90 provides a base current having a value x to cause motor 75 to rotate at a specified rpm. Torque coupler control board 87 provides a signal for controlling the amount of force coupled through torque coupler 77. The user force which is coupled back to rotor 82 of torque coupler 77 will have the effect of stalling the motor a specified number of rpms below its initial base value. Although the motor 75 is stalled by a reduction of rpm, the motor current is still at its base rpm value. When the user's force decreases below the force exerted by the UID 51, the sudden disappearance of the load at rotor 82 will cause the stall effect to be removed from the motor 75, wherein motor 75 will increase its rpm thus increasing the speed of the movement of UID 51 automatically and simulating the feel of free weight acceleration. This free weight simulation is provided by the operation of torque coupler 77 and motor 75 and is not responsive to feedback signals sensed by processor 60. Therefore almost instantaneous response is provided to the user without the need for processing of feedback signals to the processor 60. It is to be noted that the amount of force applied to the user throughout the negative stroke is controlled by the motor current and not by the viscosity of the torque coupler 77. The torque coupler 77 is merely acting as a torque limiter in this instance.

Figure 2:
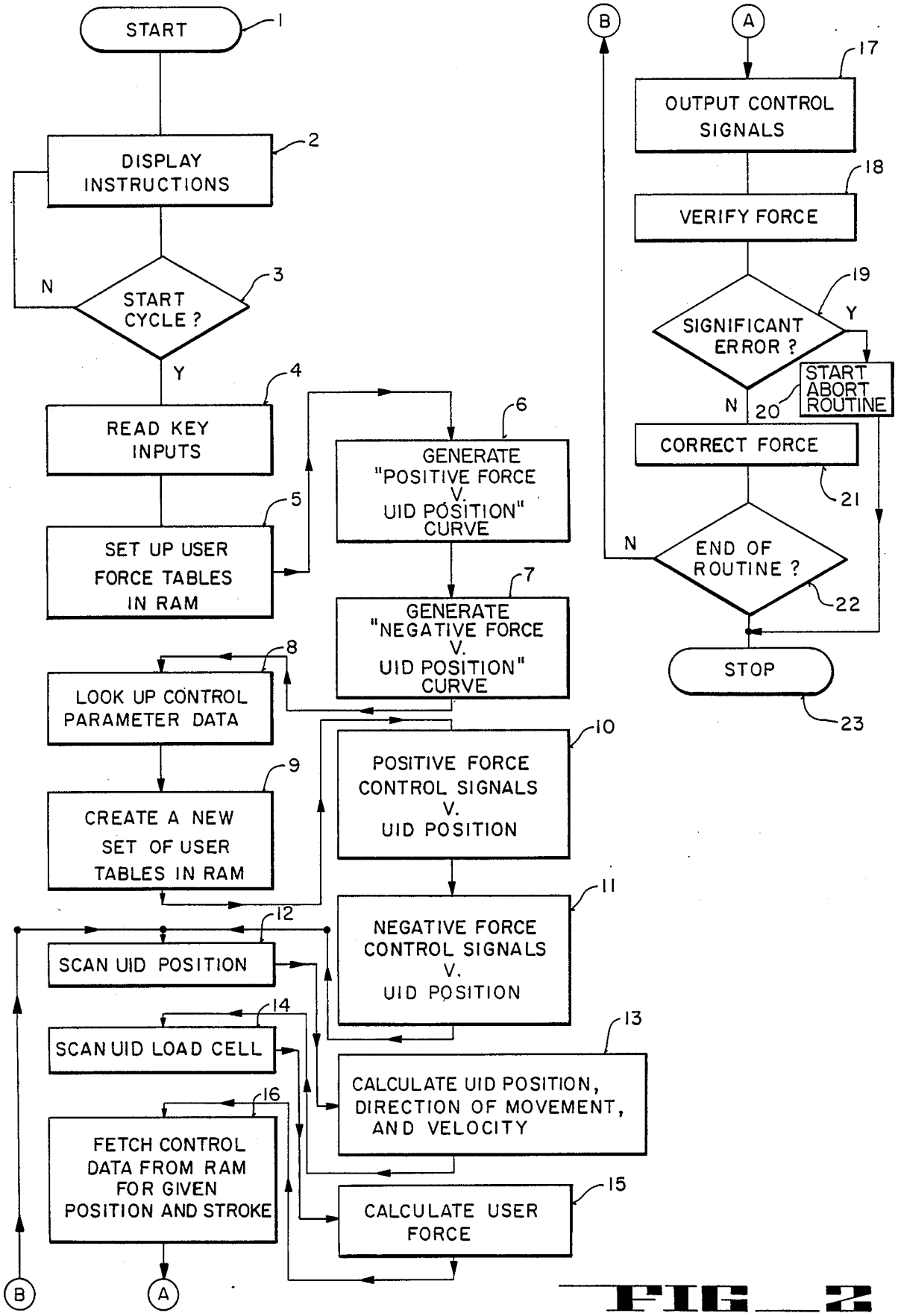
FIG. 2 is a flow diagram showing an example of a user initiated exercise routine of the preferred embodiment.

Referring to FIG. 2, an example flow chart for a program to be utilized with the processor 60 of the present invention is shown. A start sequence is commenced in block 1, wherein processor 60 boots the program in ROM 98 for controlling the progression of the exercise cycle. Instructions are displayed onto the display unit 84 in block 2 and these instructions continue to be displayed until the user commences the exercise cycle in block 3. Then, in response to the instructions, the user input is read from the keyboard 85 in block 4. The instructions also require the user to input various values to set up the force table as in block 5. The force values inputted are stored in RAM 97 and the processor 60 uses these values to generate a positive force versus UID position curve and a negative force versus UID position curve in blocks 6 and 7, respectively.

After the processor 60 retrieves the control parameter information from EEPROM 96 in block 8, a new set of user tables is created in RAM 97 in block 9. The new user table stored in RAM 97 provides control signals to torque control board 90 and torque coupler control board 87. This provides a force in relation to the position of the UID 51 during both positive and negative strokes of the exercise in blocks 10 and 11, respectively. Then, in block 12, UID position is scanned and in block 13 the position, direction of movement and velocity of the UID 51 is calculated from the UID position signal coupled to processor 60 from position sensor 59. In block 14, the load cell 63 provides the UID force signal to processor 60, wherein processor 60 calculates the user force in block 15.

Then, the processor 60 fetches data representing control signals from RAM 97 for a given position and stroke of the UID 51 in block 16. This data is converted to control signals which control the torque control board 90 and torque coupler control board 87 in block 17. In block 18, the processor 60 verifies the user force to the UID 51 force. A comparison is made in block 19 and if a significant error is noted between the two forces, the exercise is aborted in block 20. For example, the abort sequence can be initiated when the user force differs from the calculated force by a predetermined percentage. Further, the abort sequence can include a routine to deactivate solenoid 17 thereby locking the movement of UID 51 whenever user force approaches a predetermined value such as zero. If the error is not significant in block 19, then directions can be provided to the user to correct the user force in block 21.

Finally, in block 22, if the exercise routine is finished, then the routine can be terminated in block 23. However, if the exercise is not over, in block 22, then the sequence is repeated from block 12. It is to be appreciated that a rudimentary flow chart for the operation of the computerized exercise machine of the present invention is shown in FIG. 2 and that other routines can be readily implemented without departing from the spirit and scope of the present invention.

In addition, the present invention is capable of providing different modes of operation simply by varying the exercise routines which are programmed by the user. These different modes of operation include isometric exercise at different positions; positive only exercise; negative only exercise; positive-negative exercise; negative-positive exercise; isokinetic positive only exercise; passive exercise; double isokinetic exercise (isokinetic exercise in both positive and negative exercise strokes); acceleration controlled exercise; isokinetic and force in the same stroke; ideal variable resistance positive exercise; ideal variable force negative exercise; preprogrammed athletic training exercises; increase in force from repetition to repetition; force increase in one direction and force decrease in the opposite direction; as well as mode changes from repetition to repetition.

Further, the present invention is capable of communicating with the user through a full video display 84, such as a color graphics monitor, wherein UID 51 position, direction and velocity as well as the force exerted by the user and subsequent forces to be experienced can be represented in a graphical format for an easier interpretation by the user while progressing through the exercise regimen. For example, a force versus position curve can be graphically represented on the video screen and a flashing cursor can identify the location of the actual value.

Additionally the present invention can be utilized to provide measurements exerted by the user, such as maximum force that the user is capable of exerting in a positive stroke; maximum force the user is capable of exerting in the negative stroke; user force and UID speeds in each direction; and user's isometric force at every position of the UID at both positive and negative strokes.

Further, the present invention provides maximum isolation of the muscle to be exercised; provides for variable resistive forces as a function of UID position in both positive and negative exercise strokes; maintain an eccentric load on the muscle during positive exercise; maintain UID speed to provide ideal exercise speed for various different muscles; provide isokinetic positive/-negative exercise; provide isokinetic positive exercise and force controlled negative exercise; provide variable stroke lengths for positive and/or negative stroke; provide for measuring of user force (muscle strength) in positive and/or negative exercise; and simulate the "feel" and "actions" of a free weight system such that during a negative exercise stroke the UID 51 will automatically and immediately accelerate if the user's force drops below the UID 51 force. Further, the UID 51 can be made to automatically accelerate whenever the UID 51 force is programmed to increase and if the user's force does not increase to the new UID force value.

It is to be appreciated that one of the more important aspects of the present invention is the ability to provide eccentric loading during both positive and negative exercise. That is, the exercise machine applies a pulling or stretching force on the muscle during both contraction and during lengthening. This results because the UID 51 is coupled to the output rotor 82, which is then coupled to the housing 80 by magnetic particle chains. Whenever the output rotor 82, by action of the bar 64, is caused to move slower than the input housing, magnetic particles 83 are caused to be dragged through the slots in the rotor 82. The strength of this magnetic chain places a tension on the muscle which is an eccentric load on the muscle. Therefore, eccentric loading can be placed on a muscle either or both during positive and negative exercise strokes.

I claim:

1. A computerized exercise apparatus for providing positive and negative exercises comprising:

a movable user interface device (UID) for engaging a specific body part of a user;

driving means for generating a torque to drive said UID;

torque coupling means coupled to said driving means, wherein said torque coupling means couples torque from said driving means to said UID for selectively providing a resistive force to said UID in opposition to a contracting muscle of said body part and selectively applying a powering force to said contracted muscle of said body part;

mechanical coupling means coupled to said torque coupling means and said UID for transferring mechanical movement between said torque coupling means and said UID;

a processor coupled to said driving means, torque coupling means and said UID for providing control signals for operating said driving means; and torque coupling means;

a memory coupled to said processor for storing digital information used by said processor to control the operation of said driving means and said torque coupling means;

a position sensor coupled to said UID for providing UID position and direction information to said processor; and a force sensor coupled said UID for determining amount of force applied between said UID and said user and providing said force information to said processor;

wherein said driving means and said torque coupler means regulates said UID in each of its direction of movement such that said resistive force operates against a force exerted by said user and said powering force is exerted against said user, wherein said resistive force and said powering force provided by said driving means and said torque coupler means are variable throughout a range of motion of said UID.

2. The computerized exercise apparatus of claim 1, wherein said UID is caused to provide a positive exercise movement whenever said force exerted by said user is greater than said resisting force coupled to said UID.

3. The computerized exercise apparatus of claim 2, wherein said UID is caused to provide a negative exercise movement whenever said powering force coupled to said UID exceeds said force exerted by said user.

4. The computerized exercise apparatus of claim 3, wherein said driving means includes a motor to produce said torque.

5. The computerized exercise apparatus of claim 4, wherein said torque coupling means includes a variable viscosity electromagnetic torque coupler in which output torque of said torque coupling means is determined by input torque provided by said driving means and viscosity of magnetic powder disposed within said variable viscosity electromagnetic torque coupling means, the viscosity being determined by a magnetic field generated from a coil disposed within said variable viscosity electromagnetic torque coupling means.

6. The computerized exercise apparatus of claim 5 further including user interface means coupled to said processor for permitting inputting commands to said processor.

7. The computerized exercise apparatus of claim 6, wherein said user interface means further includes a keyboard for permitting said user to input commands to said processor.

8. The computerized exercise apparatus of claim 7, wherein said user interface means further includes a display device coupled to said UID for displaying information provided by said processor to said user.

9. The computerized exercise apparatus of claim 8, wherein said memory stores a plurality of software routines, whereby said processor generates different control signals for a variety of exercise routines, wherein said variety of exercise routines including isometric exercise at different positions of said UID, positive only exercise, negative only exercise, a combination of positive-negative exercise, a combination of negative-positive exercise, isokinetic positive only exercise, passive exercise, double isokinetic exercise, acceleration controlled exercise, a combination of isokinetic and force exercise, variable resistance positive exercise, variable force negative exercise, repetitive strokes wherein exercise force is increased from repetition to repetition, a combination of a force increase in one exercise direction and a force decrease in an opposite direction.

10. An eccentrically loaded computerized exercise apparatus for providing a variable powering and resistive forces to provide positive and negative exercises in exercising a specific body part of a user for muscular development, comprising:

a moveable user interface device (UID) for engaging the specific body part of the user, said UID including a rigid frame to provide isolation of a user specific muscle;

a motor for generating a motor torque;

a torque coupler coupled to said motor for regulating an amount of said motor torque coupled as an output torque from said torque coupler, and for selectively providing the resistive force to said UID in opposition to a contracting muscle of said body part of the user and selectively applying the powering force to said contracted muscle of said body part of the user;

mechanical coupling means coupled to said torque coupler and to said UID for mechanically transferring said resistive and powering forces between said UID and said torque coupler;

a processor for controlling operation of said motor, said processor coupled to provide a torque control signal for controlling a motor current supplied to said motor, wherein said motor torque generated by said motor is a function of said motor current;

said processor also coupled to provide a torque coupler control signal for controlling a coil current supplied to said torque coupler, wherein said coil current regulates said amount of motor torque coupled through said torque coupler to said mechanical coupling means;

a memory coupled to said processor for storing information used by said processor to control the operation of said driving means and said torque coupling means;

user interface means coupled to said UID for coupling information between said processor and said UID;

a position sensor coupled to said UID and said processor for providing said processor with UID direction and position information throughout said UID's range of motion;

a force sensor coupled to said UID for determining amount of force applied between said UID and said user and providing said force information to said processor.

11. The computerized exercise apparatus of claim 10, wherein said UID is caused to provide a positive exercise movement whenever said force exerted by said user is greater than said resisting force coupled to said UID.

12. The computerized exercise apparatus of claim 11, wherein said UID is caused to provide a negative exercise movement whenever said powering force coupled to said UID exceeds said force exerted by said user.

13. The computerized exercise apparatus of claim 12, wherein said processor controls an amount of said resistive and powering forces provided to said UID.

14. The computerized exercise apparatus of claim 13, wherein said torque coupler is comprised of a variable viscosity electromagnetic torque coupler having magnetic powder disposed therein, such that said coil current determines viscosity of said magnetic powder in relation to an output shaft of said torque coupler, said viscosity determining said amount of motor torque being coupled by said torque coupler to said mechanical coupling means.

15. The computerized exercise apparatus of claim 14, wherein said user interface means includes a display device for displaying information to said user and further including a keyboard for inputting information to said processor.

16. The computerized exercise apparatus of claim 15, wherein said memory stores information inputted by said user.

17. The computerized exercise apparatus of claim 16, wherein said memory further stores a feed forward control program which provides for conversion of said user inputs to appropriate values by said processor for controlling said motor current and said coil current.

18. The computerized exercise apparatus of claim 17, wherein said memory further stores control parameter information for providing operational parameters of said UID.

19. The computerized exercise apparatus of claim 18, wherein said UID is a rotatably moving device.

20. The computerized exercise machine of claim 19, wherein said mechanical coupling means is comprised of a gear reducer/increaser and a sprocket and chain assembly, such that said gear reducer/increaser is coupled to said torque coupler and said sprocket and chain assembly is coupled to said gear reducer/increaser and said UID.

21. The computerized exercise apparatus of claim 20, wherein said memory stores a plurality of software routines, whereby said processor generates different control signals for a variety of exercise routines, wherein said variety of exercise routines including isometric exercise at different positions of said UID, positive only exercise, negative only exercise, a combination of positive-negative exercise, a combination of negative-positive exercise, isokinetic positive only exercise, passive exercise, double isokinetic exercise, acceleration controlled exercise, a combination of isokinetic and force exercise, variable resistance positive exercise, variable force negative exercise, repetitive strokes wherein exercise force is increased from repetition to repetition, a combination of a force increase in one exercise direction and a force decrease in an opposite direction.

* * * * *